US006220943B1

(12) United States Patent
Wang et al.

(10) Patent No.: US 6,220,943 B1
(45) Date of Patent: Apr. 24, 2001

(54) METHOD AND APPARATUS FOR REPAIRING AND REMOVING SCRATCHES FROM PHOTOGRAPHIC MATERIAL SURFACES

(75) Inventors: Yongcai Wang, Penfield; Jeffrey A. Trest; Alfred B. Fant, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/207,446

(22) Filed: Dec. 8, 1998

(51) Int. Cl.[7] ..... B24B 7/00
(52) U.S. Cl. ..... 451/67; 451/59; 451/60
(58) Field of Search ..... 451/36, 41, 57, 451/59, 60, 65, 67, 296, 301, 184; 15/100, 102; 134/65 P, 122 P; 396/604, 606, 609

(56) References Cited

U.S. PATENT DOCUMENTS 4,254,585 * 3/1981 Schoettle et al. ..... 51/5 A
4,582,784 4/1986 Fukugawa et al. .
4,706,325 * 11/1987 Michelson ..... 15/308
4,735,976 4/1988 Steklenski et al. .
5,221,975 6/1993 Kessler .
5,255,114 10/1993 Kessler .
5,309,192 * 5/1994 Lu ..... 354/317
5,733,179 * 3/1998 Bauer ..... 451/41
5,930,857 * 8/1999 Ramos et al. ..... 15/3

* cited by examiner

*Primary Examiner*—Timothy V. Eley
*Assistant Examiner*—Dung Van Nguyen
(74) *Attorney, Agent, or Firm*—Doreen M. Wells

(57) ABSTRACT

The present invention describes an apparatus for removing scratches from a photographic element. The apparatus includes an application device for applying a wax composition to a surface of a moving photographic web; and a buffing device for buffing the surface of the web having the applied wax composition. The present invention is also a method for removing scratches from a photographic element. The method includes the steps of providing a moving photographic web, applying the wax composition to a surface of the photographic web, and rubbing the wax composition with sufficient force thereby removing the residual wax composition to produce a refinished surface substantially free of all defects and scratches.

15 Claims, 10 Drawing Sheets

METHOD AND APPARATUS FOR REPAIRING AND REMOVING SCRATCHES FROM PHOTOGRAPHIC MATERIAL SURFACES

CROSS REFERENCE TO RELATED APPLICATIONS

This application relates to commonly assigned copending application Ser. No. 09/207,376, filed simultaneously herewith incorporated by reference herein.

FIELD OF THE INVENTION

The present invention relates to an apparatus and method for removing scratches and other imperfections on the surface of a photographic material in order to improve the quality of photographic prints or projected photographic images or scanned images by an optical scanner.

BACKGROUND OF THE INVENTION

Photographic light-sensitive materials are generally composed of light-sensitive photographic emulsion layers and light insensitive layers such as an interlayer, an emulsion protective layer, a filter layer, or an antihalation layer applied, directly or indirectly through a subbing layer, to one side or both sides of the support consisting of, for example, an α-olefin such as polystyrene or polyethylene, a cellulose ester such as cellulose acetate or nitrocellulose, a polyester such as polyethylene terephthalate or polyethylene napththalate, paper, or a synthetic paper. In light-sensitive materials such as color photographic elements, auxiliary layers such as an antistatic layer, a curl preventing layer, a magnetic recording layer, a barrier layer, a scratch resistant overcoat layer, or a surface lubricant layer, are provided on the back side of the support in order to enhance photographic or physical quality of the photographic light-sensitive materials.

It is always desirable to have a backside protective overcoat that serves as many functions as possible in order to reduce manufacturing complexity and cost. It is also desirable to have such a layer formed by coating and drying from coating compositions based on solvents that are less hazardous to the environment.

Prior art has disclosed the use of a protective overcoat or a "barrier" layer to maintain post-process conductivity of an antistat. Typically such protective overcoats are composed of hydrophobic materials such as cellulose acetates, cellulose acetate butyrates, cellulose acetate propionates, cellulose itrates, polyacrylates, polymethacrylates, polystyrene, and poly(vinyl acetal).

When such hydrophobic barrier layers are used as an outermost surface layer, deposition of material or "scum" formation on the outermost surface following photographic processing is commonly seen. For example, U.S. Pat. No. 4,735,976 discusses how surfactant from the final photographic processing solution, known as the stabilizer solution, can form a deposit on the outermost surface layer and thereby lead to an objectionable surface haze or scum. Similarly, U.S. Pat. No. 4,582,784 discusses the occurrence of spotted drying unevenness on the outermost surface. Another type of processing scum that is particularly troublesome is hard-water scum. Processing laboratories that are located in hard-water areas are particularly susceptible to this problem. After processing in solutions prepared using hard-water, a white hazy surface scum, sometimes uniform and sometimes more liney and streaky, can be seen on the film. Chemical analysis of the hard-water scum typically reveals hard-water salts of calcium, magnesium, and sodium.

Such surface deposits (contaminates) can impact the physical performance of the element in a variety of ways. For example, large deposits of material on a photographic film lead to readily visible defects on photographic prints or are visible upon display of motion picture film. Alternatively, post-processing debris can influence the ability of a processed film to be overcoated with an ultraviolet curable abrasion resistant layer, as is done in professional photographic processing laboratories employing materials such as PhotoGard™, 3M. Finally, processing residue on photographic elements can impact the ability to read magnetically recorded information on a processed film, such as the new Advanced Photographic System films.

During the manufacturing and processing of photographic materials such as coating, drying, finishing, winding, rewinding, processing, printing, the surfaces of the photographic material are often harmed by contact friction with the apparatus parts, or scratched by hard debris or objects such as dust, sand, grit, or any other abrasive materials attached to those apparatus. These scratches can deface the image during printing and projecting processes.

Heretofore, there have been various proposals to obtain a physically improved photographic material by increasing the abrasion and scratch resistance of the overcoat layer, or by reducing the contact friction of the photographic material to other surfaces so that it will not be damaged during the manufacturing, exposure, developing, and printing or projecting processes. For example, methods for improving the scratch resistance include adding a certain class of hardener to gelatin; using colloidal silica in the overcoat layer either alone or in combination with a water soluble polymer having a carboxylic acid group; using two overcoat layers, the upper layer containing a colloidal silica and the lower layer containing a polymer latex; and using a composite latex comprising a polymeric acrylic acid ester and/or a polymeric methacrylate acid ester and colloidal silica. Methods for reducing the contact friction include incorporating both a silicone fluid and a surface active agent into the protective overcoat; using a mixture of dimethyl silicone and diphenyl silicone on the backside of the support; incorporating a triphenyl terminated methyl phenyl silicone into the emulsion protective overcoat; using a combination of dimethyl silicone and beta-alanine derived surfactants; using modified sperm oils in the protective overcoat; using liquid organopolysiloxane with methyl and alkyl or aryl, or aralkyl side groups in the protective overcoat; and by using polysiloxane with polyether side chains on the backside of the support.

In recent years, the conditions under which photographic materials are manufactured and utilized have become more severe. This is either because applications of photographic elements have been extended to more harsh conditions such as high humidity and high temperature or because preparation methods have been advanced, including high speed coating, high speed finishing and cutting, and faster processing. Further, the emulsion layers have been progressively thinned. Under these conditions, photographic elements, materials are more severely scratched and the above-mentioned methods have to be modified, or improved, or optimized for best protection.

Recent patents have described apparatus for scanning and digitizing photographic images. For example, U.S. Pat. Nos. 5,221,975 and 5,255,114 describe a high resolution scanner which is adapted to digitally record an image from a photographic film. The scanner comprises a folded integrating sphere which projects illumination on the film as the film is moved relative to the integrating sphere. Light transmitted through the film is directed to a photodetector by an optical system. It is expected that aforementioned surface scratches and contaminates can significantly influence the ability of the high resolution optical scanner to digitally record images from photographic films.

The foremost objective of the present invention is to provide methods for removing scratches and other defects from the surface of a photographic material in order to improve the quality of photographic prints or projected photographic images or scanned images by an optical scanner.

SUMMARY OF THE INVENTION

The present invention describes an apparatus for removing scratches from a photographic element. The apparatus includes an application device for applying a wax composition to a surface of a moving photographic web; and a buffing device for buffing the surface of the web having the applied wax composition. The present invention is also a method for removing scratches from a photographic element. The method includes the steps of providing a moving photographic web, applying the wax composition to a surface of the photographic web, and rubbing the wax composition with sufficient force thereby removing the residual wax composition to produce a refinished surface substantially free of all defects and scratches.

For a better understanding of the present invention along with other advantages and modifications thereof, reference made to the following description and appended claims.

DETAILED DESCRIPTION OF THE INVENTION

The present invention relates to a method for removing scratches and imperfections from a photographic material comprising an application device for applying to the surface of the photographic material a wax composition and a smoothing device for buffing the surface of the photographic material having the applied wax composition.

The application device applies a wax composition to the surface of a photographic material by rotating and rubbing. The process removes or smoothes out of the grinding lines, scratches, pits, and certain other surface defects such as scum that adversely affect the use of the photographic material by printing, projecting, or scanning.

The buffing roll removes the residual wax composition to produce a refinished surface. The buffing roll can be a rotating buffing roll, typically foam or cloth, treated with an appropriate compound. Buffing serves to complete the process and produce a scratch free and clean surface.

Reference will now be made in detail to preferred embodiments of the invention, examples of which are illustrated in the accompanying drawings. Wherever possible, the same reference numbers will be used throughout the drawings to refer to same or like parts.

Figure 1:
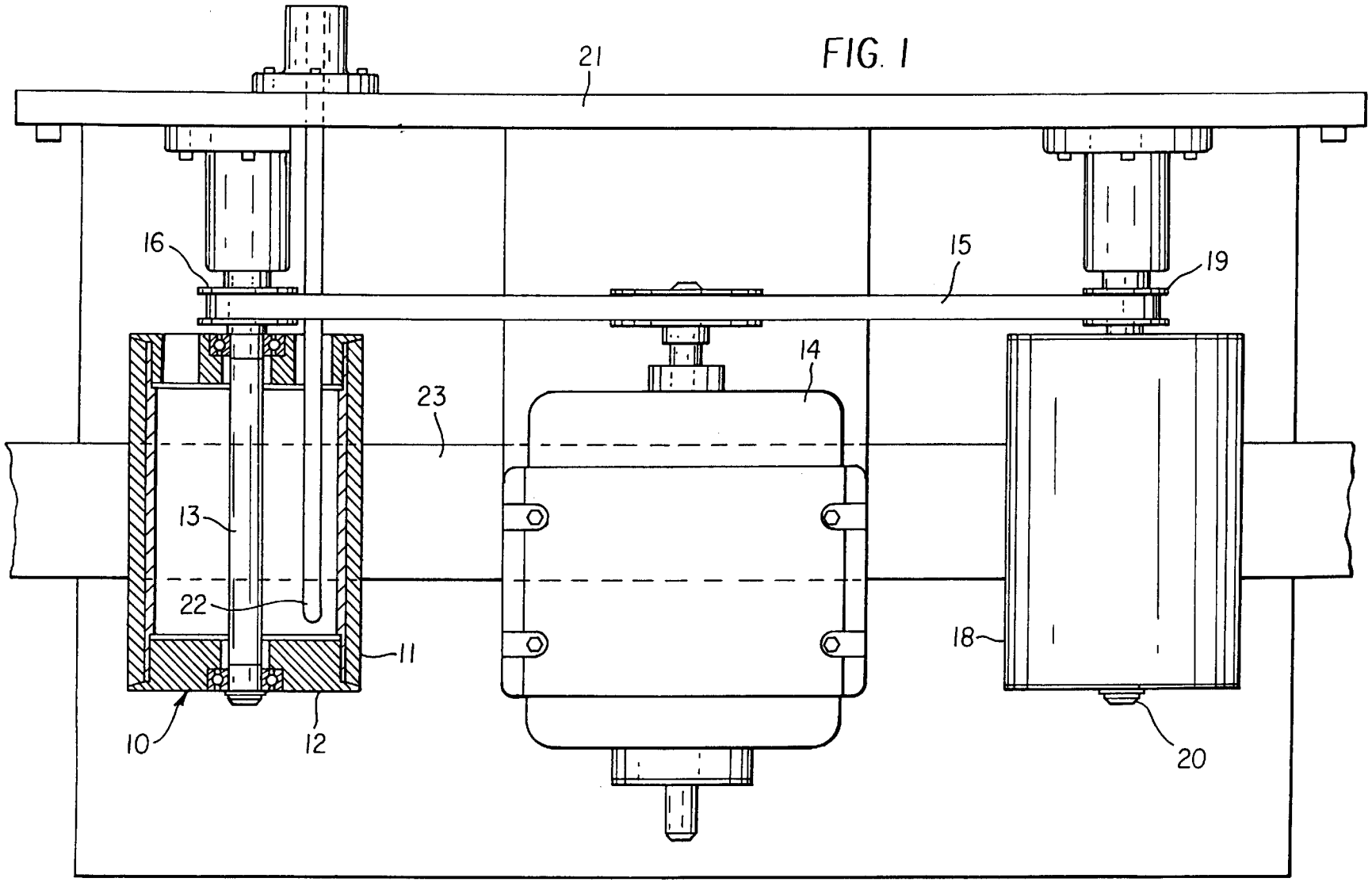
FIG. 1 shows an overhead view, partially sectioned of one embodiment of the wax applicator device of the present invention.
Figure 2:
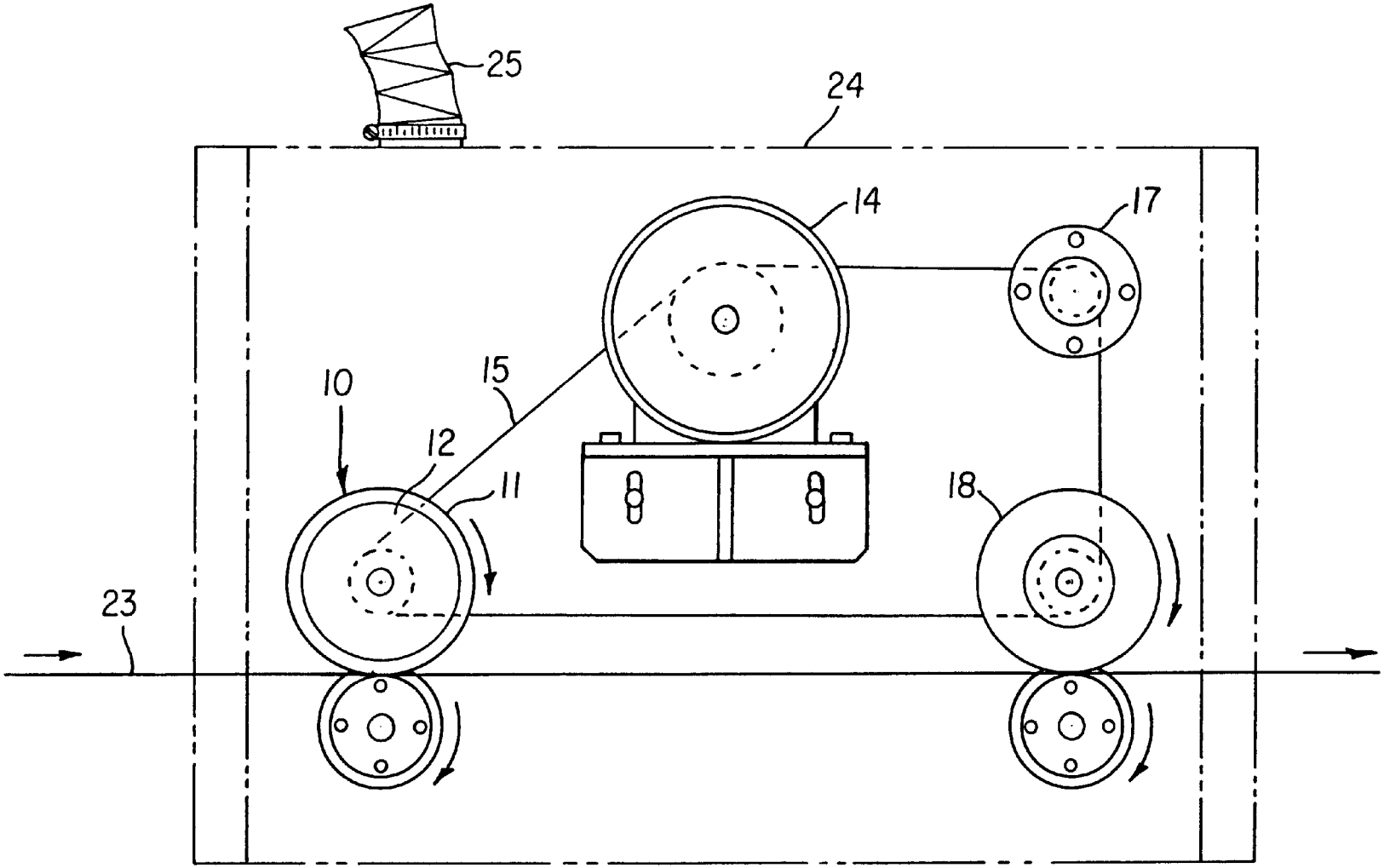
FIG. 2 shows a side view of one embodiment of the wax applicator device of the present invention.
Figure 3:
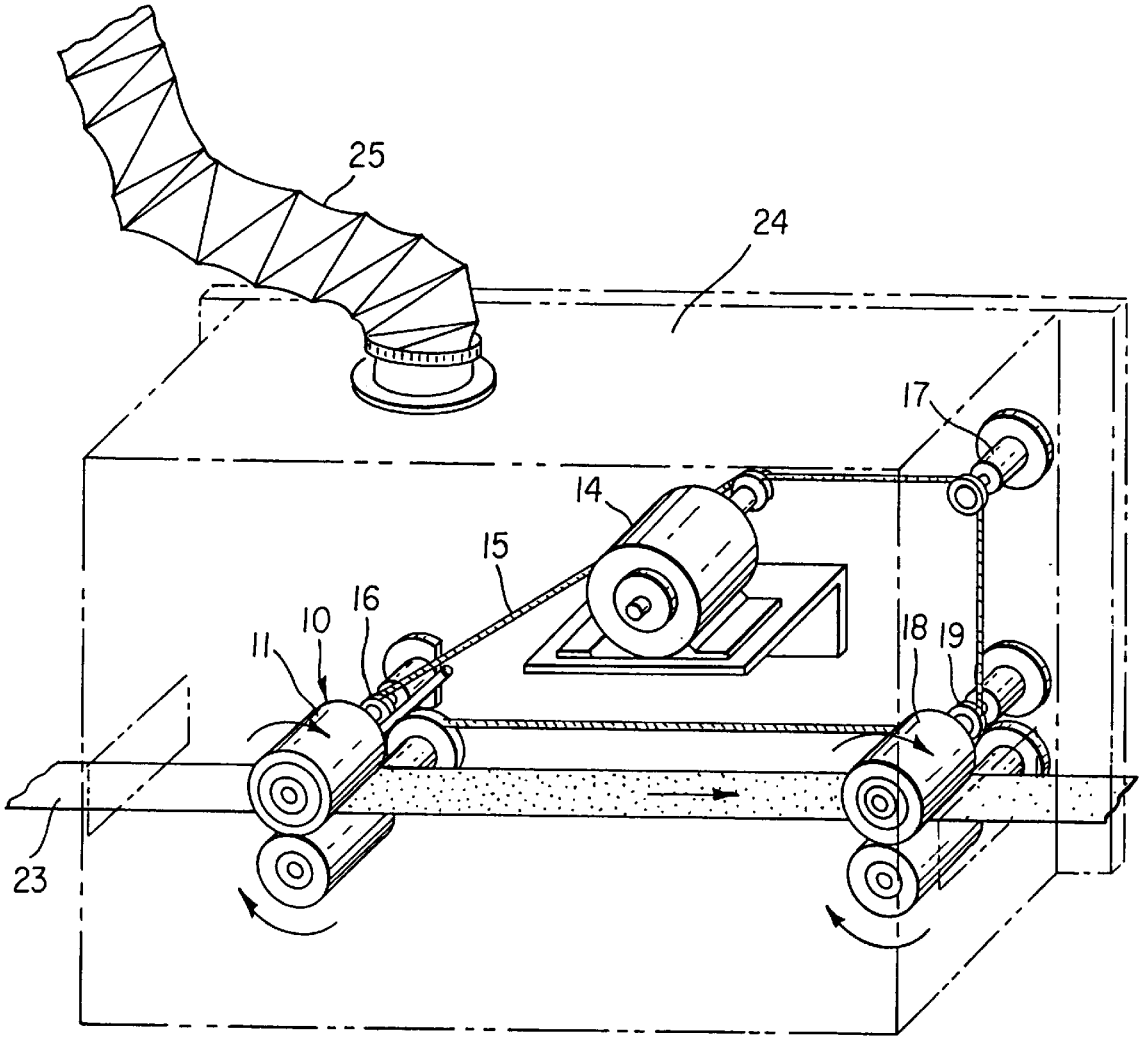
FIG. 3 shows a perspective view of one embodiment of the wax applicator device of the present invention.

Referring now to FIGS. 1, 2, and 3, it may be seen that in one embodiment of the apparatus of the present invention there is included a wax applicator roll 10. The wax applicator roll (sectional view) includes an open cell foam material 11 pre-impregnated with any of the wax compositions and mounted on a rigid thin walled core with a hollow inner area 12. The foam covered core is rotatably mounted on a spindle 13 via a variable speed drive motor 14 connected to the applicator roll drive mechanism via a drive belt 15 and pulley 16. The drive belt runs over a tensioning device 17 and a buffing roll 18 also rotatably mounted with a pulley 19 and spindle 20. Permanently affixed to the back plate 21 which holds the wax applicator spindle rotating mechanism is a heating element 22 which extends through the inner area of the core such that the core can be rotated around the element. The heating element maintains the wax temperature slightly below the glass transition temperature for more uniform wax application. The wax applicator rotates in the opposite direction of the web 23 as shown by the arrows in FIGS. 2 and 3 to provide maximum shear of the wax as it is applied. The buffing roll 18 also rotates in the opposite direction of the web 23 as shown by the arrows in FIGS. 2 and 3 to provide maximum shear of the wax as it is buffed. Both the wax applicator roll 10 and buffing roll 18 can be removed from their respective drive shafts and replaced with new units when necessary; in the case of the wax applicator, when the wax is expended and in the case of the buffing roller when the buffing material is glazed and is no longer effective. The entire unit is mounted in an enclosure 24 supplied with clean filtered air duct 25 to maintain positive pressure within the enclosure to prevent contamination with debris and particulate from outside the enclosure while continually flushing the area of any contaminants generated in the application process.

The web is supported by two idler rollers in FIGS. 2 and 3, one roller under the wax application roller cover 11 and the other under the buffing roller 18. In each instance the idler rollers serve two purposes; a means of supporting the web 23 as it is transported through the device, and to provide sufficient back pressure on the web 23 to ensure proper contact with the wax applicator roll covering 11 and the buffing roller.

Figure 4:
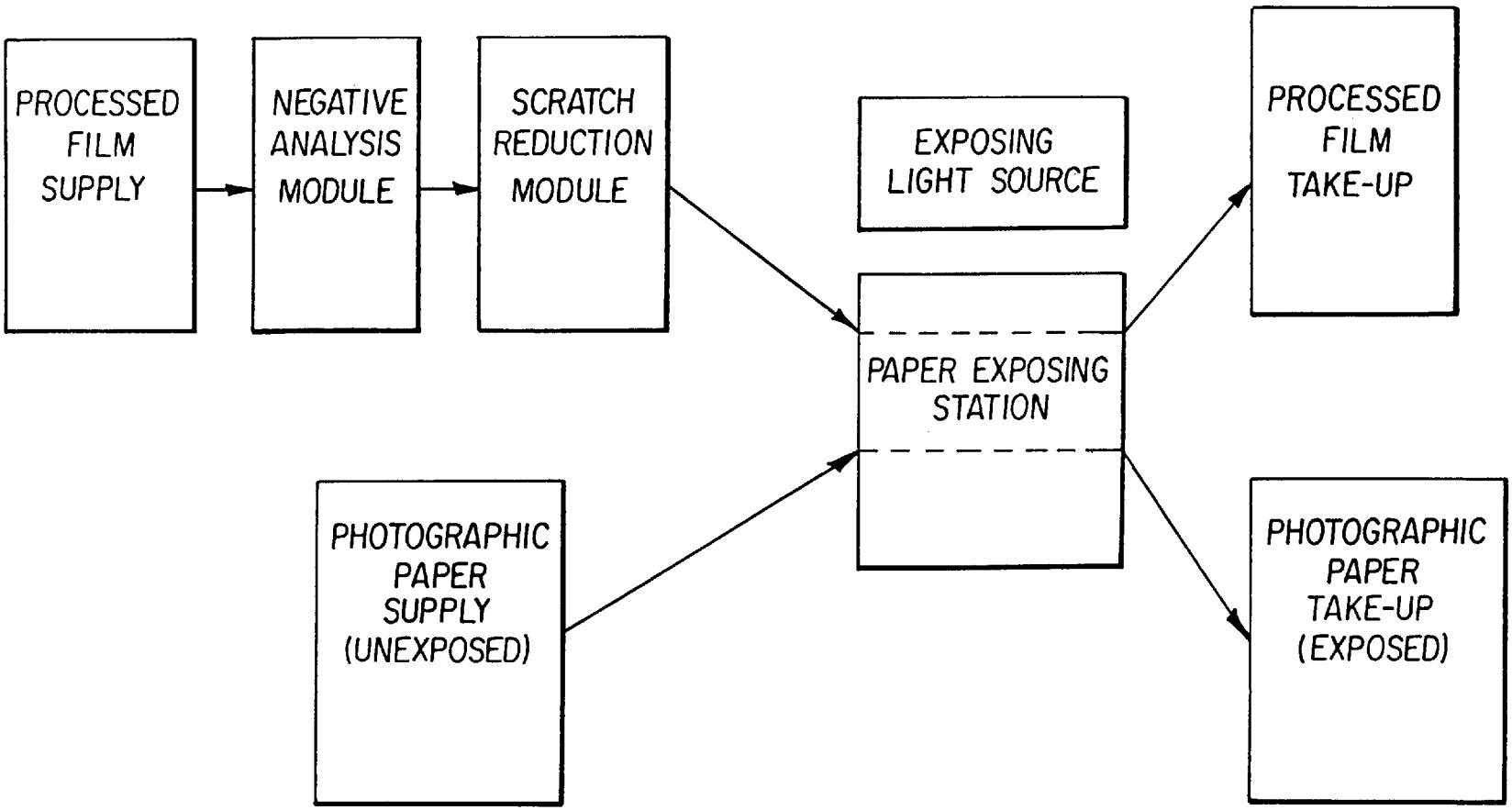
FIG. 4 is a photographic printer schematic.

The scratch reduction apparatus or module is mounted in a photographic printer between the negative analysis module and the paper exposing station as depicted in the Photographic Printer Schematic, FIG. 4. FIG. 4 is a schematic of a high-speed photographic printer, showing sequential operations performed on the processed film to create a photograph. The processed film is unwound from a processed film supply, analyzed by the printer's computer to set the correct exposing conditions in the negative analysis module, treated by the present invention to remove scratches in scratch reduction module, moved to the paper exposing station, and wound onto a roll in the processed film take up station. The film can be treated in the scratch reduction module prior to analysis in the negative analysis module. Simultaneously, the unexposed paper is unwound from the photographic paper supply, exposed in the paper exposing station and collected in the photographic paper take up station.

Figure 5:
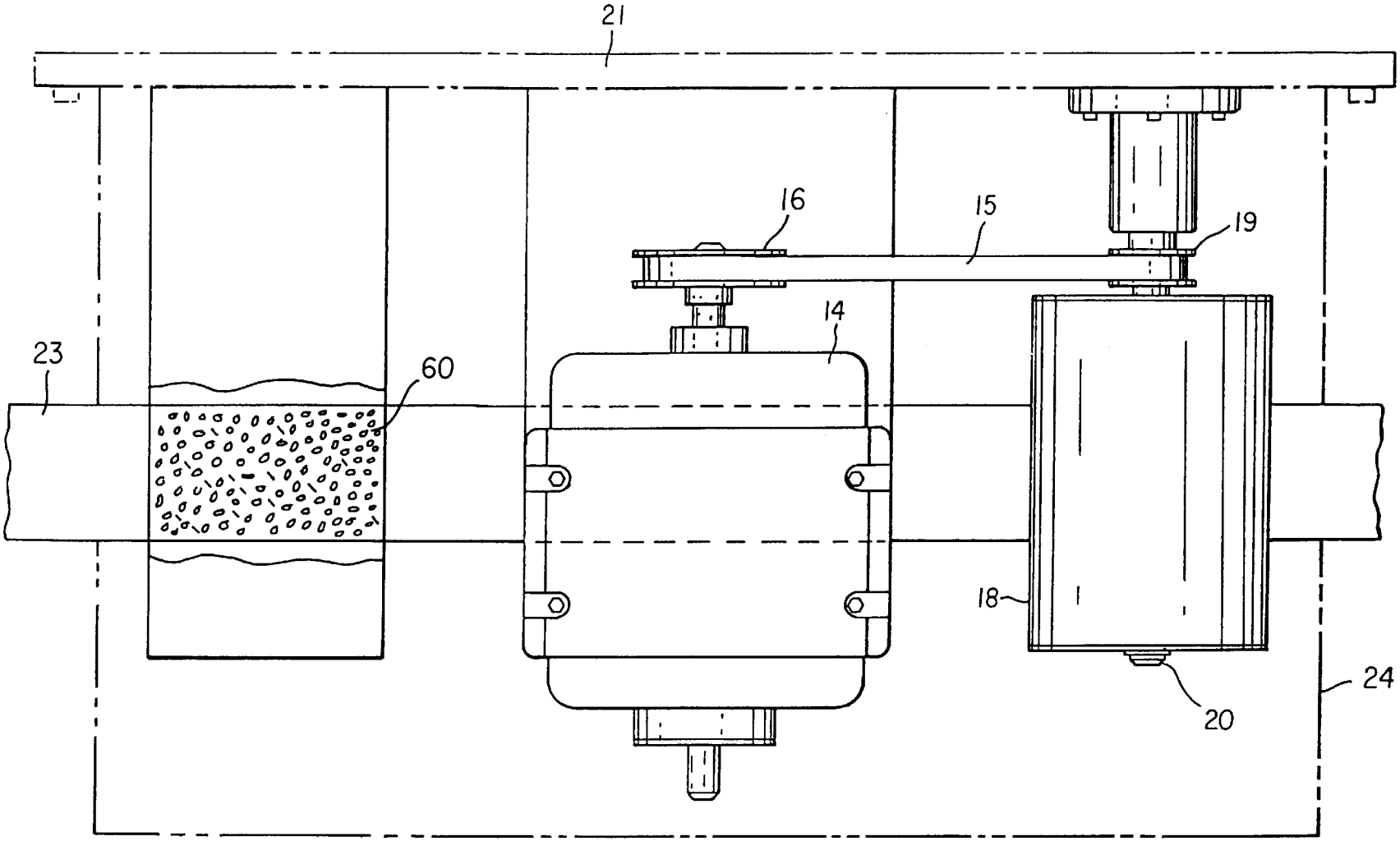
FIG. 5 shows an overhead view, partially sectioned of an alternate embodiment of the wax applicator device of the present invention.
Figure 6:
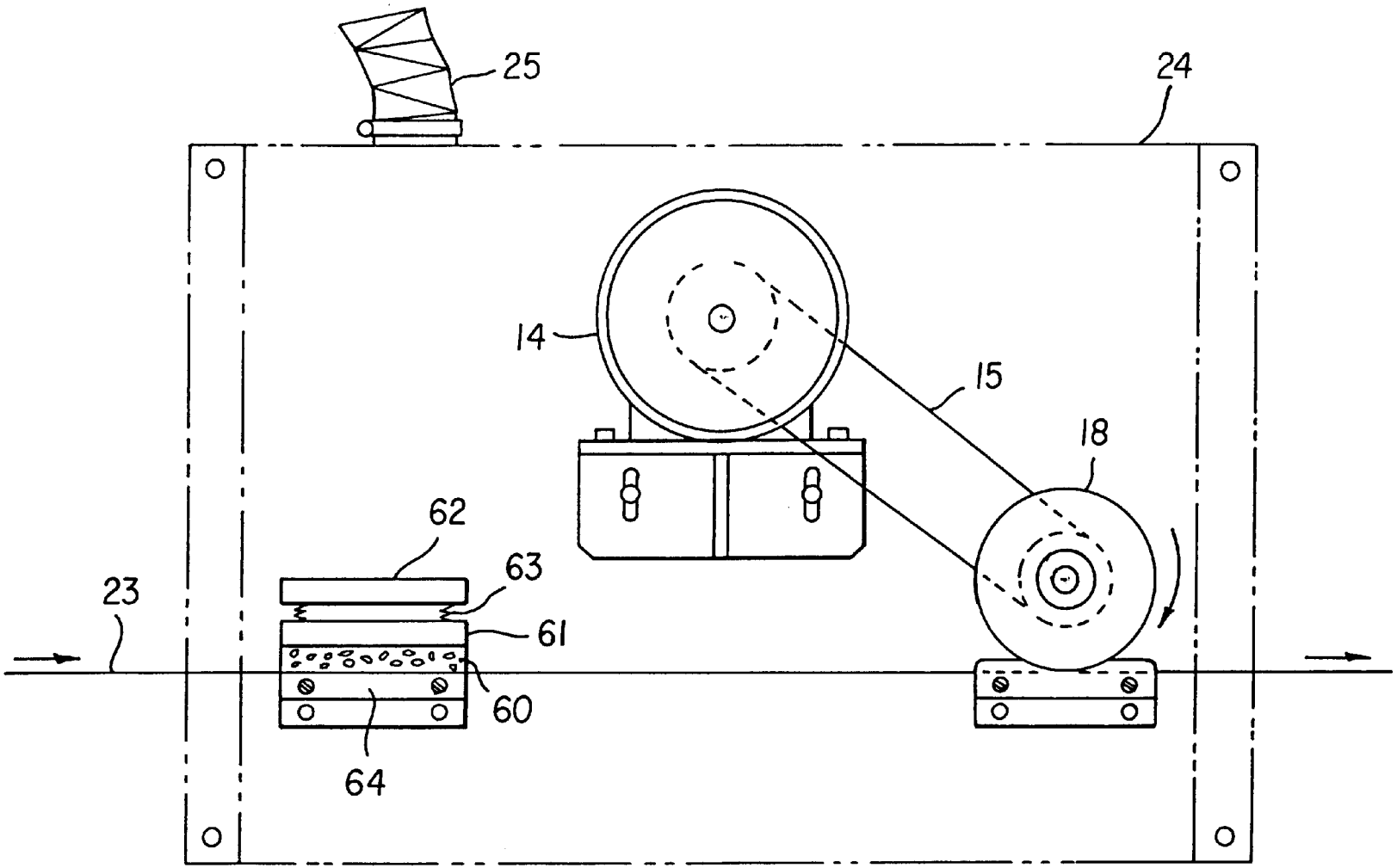
FIG. 6 shows a side view of an alternate embodiment of the wax applicator device of the present invention.
Figure 7:
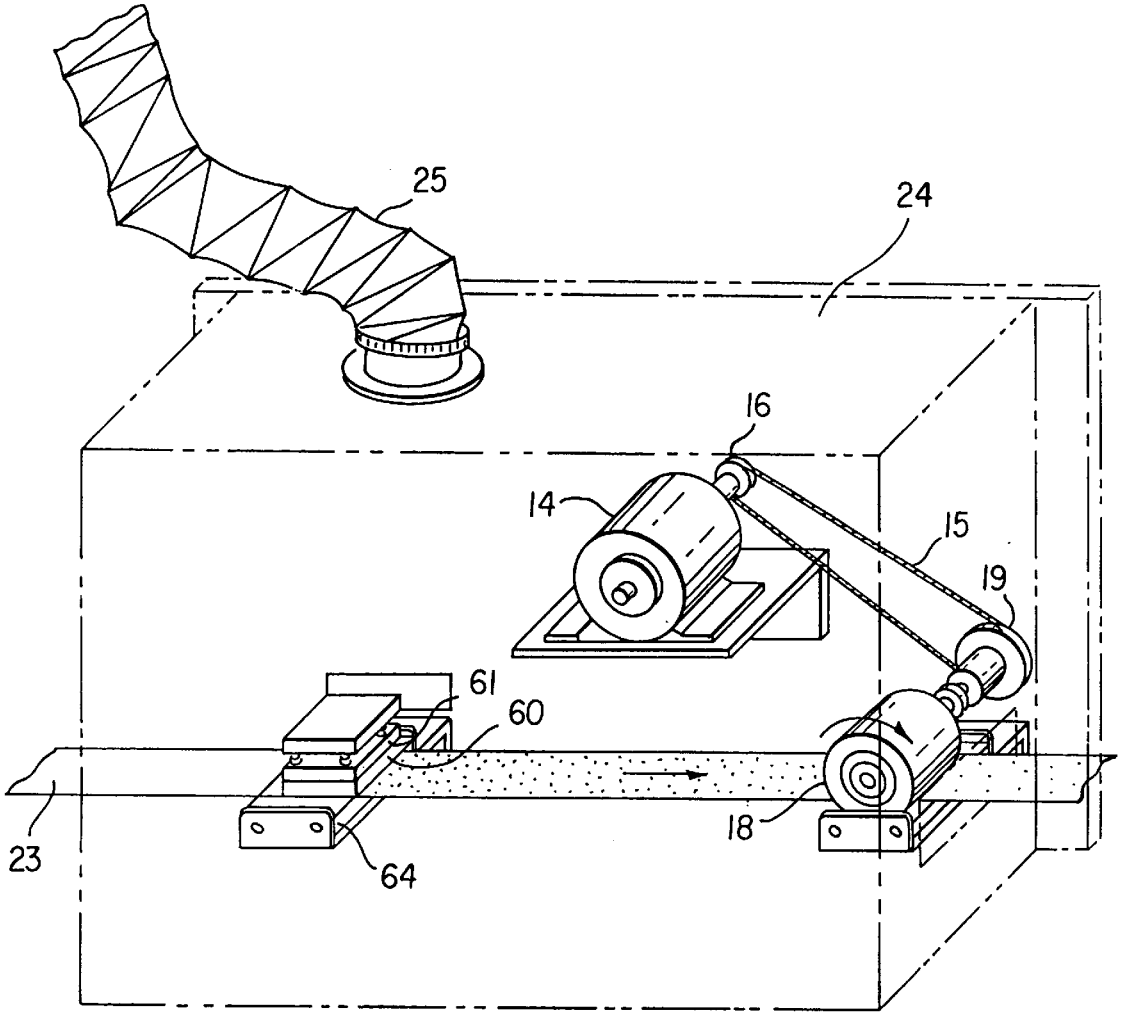
FIG. 7 shows a perspective view of an alternate embodiment of the wax applicator device of the present invention.

Another embodiment is shown in FIGS. 5–7. FIGS. 5, 6, and 7, show an alternate embodiment of the apparatus of the present invention which includes a wax applicator sponge 60. The wax applicator sponge comprises an open cell foam material pre-impregnated with any of the wax compositions and suitably mounted to a pressure plate 61. The pressure plate is mounted to a moveable adjusting plate 62 via a set of springs 63 whose spring constant is chosen for the proper pressure for application of the wax without affecting travel of the substrate. Another plate 64 is mounted behind the substrate to provide a force opposite to the force of the pressure plate. A cloth buffing roll 18 is rotatably mounted with a pulley 19 and spindle 20 and is attached to a variable speed drive motor 14 via a drive belt 15 and pulley 16. The buffing roll 18 rotates in the opposite direction of the web 23 as shown by the arrows in FIGS. 6 and 7 to provide maximum shear of the wax as it is buffed. Both the applicator sponge and the buffing roll can be easily removed from their respective units and replaced when necessary; in the case of the wax applicator, when the wax is expended and in the case of the buffing roller when the buffing material is glazed and is no longer effective. The entire unit is mounted in an enclosure 24 supplied with clean filtered air to maintain positive pressure within the enclosure to prevent contamination with debris and particulate from outside the enclosure while continually flushing the area of any contaminants generated in the application process. The scratch reduction apparatus or module is mounted in a photographic printer between the negative analysis module and the paper exposing station as depicted in the Photographic Printer Schematic, FIG. 4.

A second plate is mounted under the buffing roll in FIGS. 6 and 7 to transport the web 23 through the device and to provide sufficient back pressure on the web 23 to ensure proper contact with the buffing roll 18. This plate could be replaced by an idler roller similar to that described in the previous embodiment in FIGS. 2 and 3.

Figure 8:
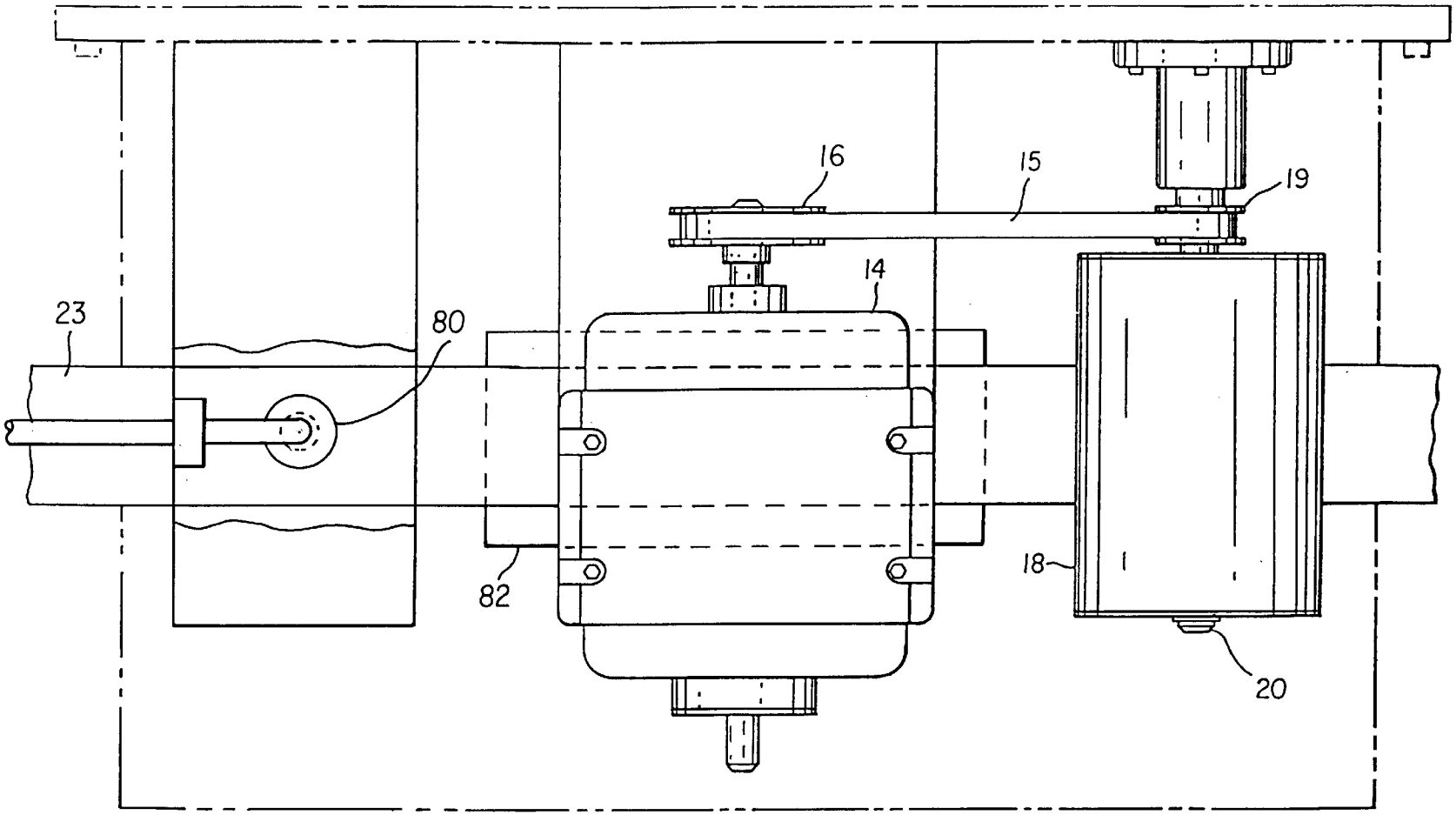
FIG. 8 shows an overhead view, of an alternate embodiment of the wax applicator device of the present invention.
Figure 9:
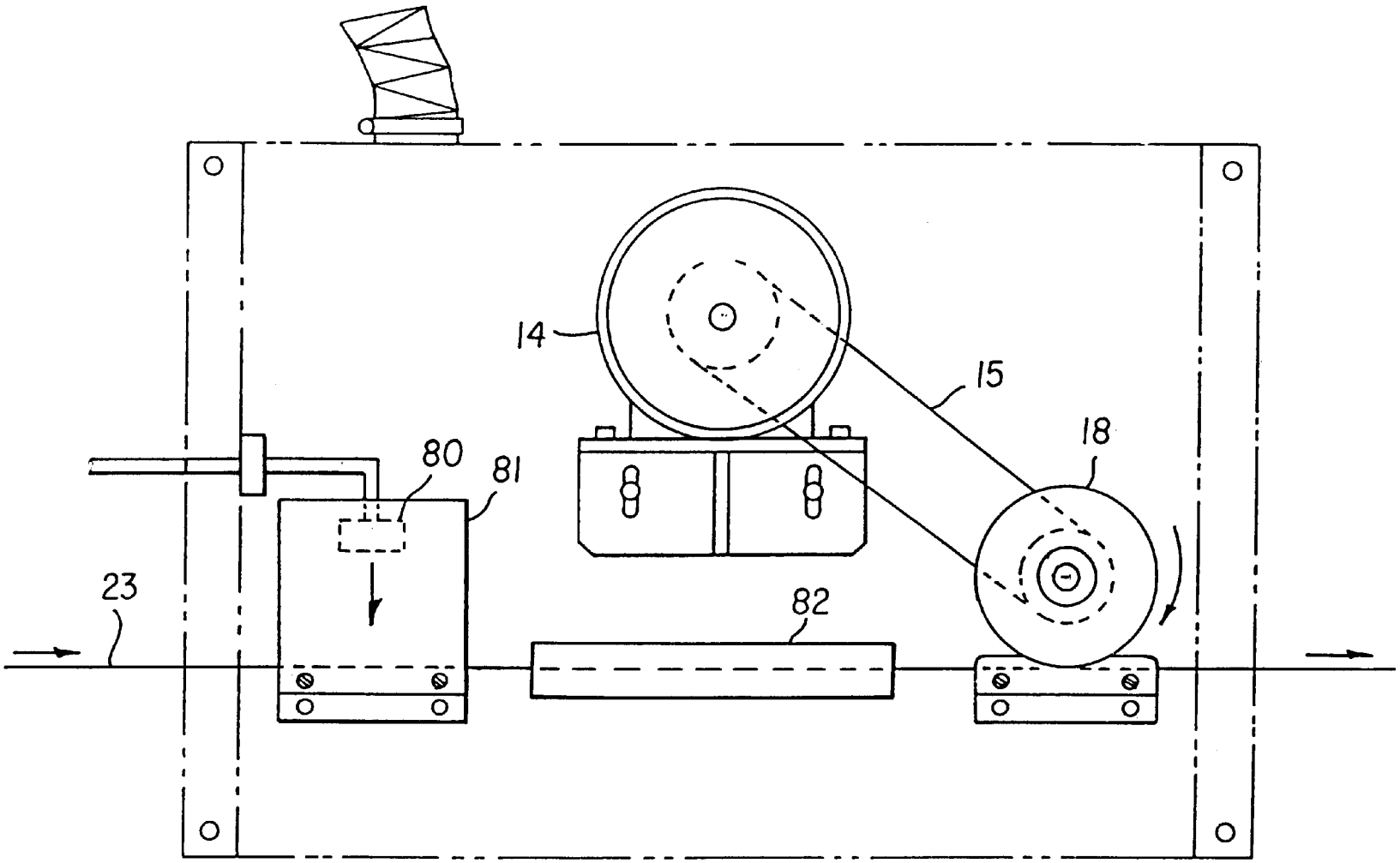
FIG. 9 shows a side view of an alternate embodiment of the wax applicator device of the present invention.
Figure 10:
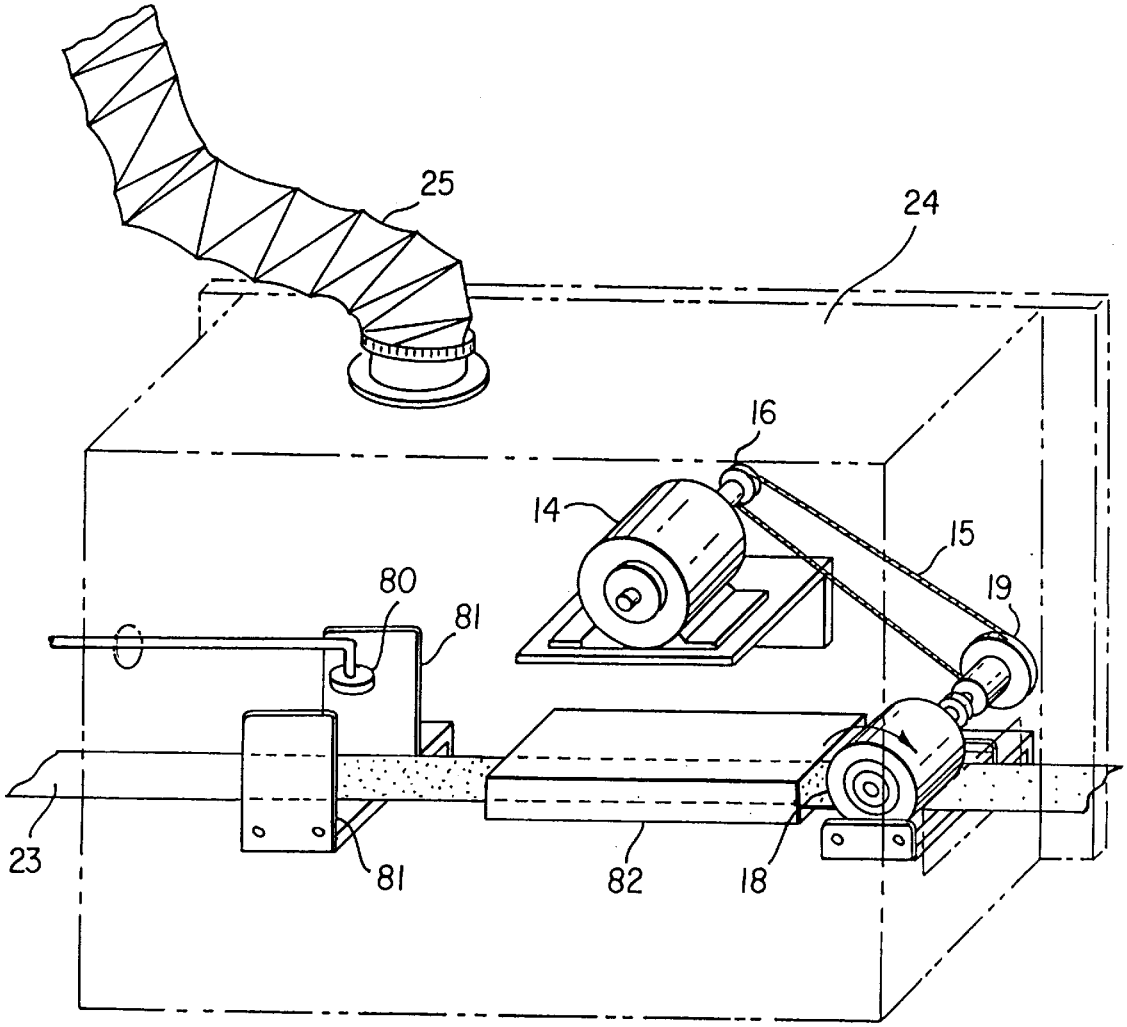
FIG. 10 shows a perspective view of an alternate embodiment of the wax applicator device of the present invention.

Another embodiment is shown in FIGS. 8–10. FIGS. 8, 9, and 10, show an alternate embodiment of the apparatus of the present invention which includes a spray wax mechanism 80. The spray wax mechanism includes a holding vessel (not shown) from which the wax composition is supplied from by means of a pump (not shown) or by pressurizing the holding vessel to send the solution through a conduit (not shown) to the spray head 80. The wax exits the spray head 80 which is designed to provide a spray pattern that covers the full width of the web 23 while minimizing over spray. To assist in the minimization of over spray and to prevent contamination of the apparatus, two spray guides 81 are provided. The spray guides 81 are adjustable to allow the apparatus to be used with different widths of films. Immediately after the wax is applied, the web passes through a dryer 82 which is supplied with heated air (not shown) to ensure that the wax composition is dry before it is buffed via a cloth or foam buffing roll 18. The cloth buffing roll 18 is rotatably mounted with a pulley 19 and spindle 20 and is attached to a variable speed drive motor 14 via a drive belt 15 and pulley 16. The buffing roll rotates in the opposite direction of the web 23 (as shown by the arrows) to provide maximum shear of the wax as it is buffed. The buffing roll can be easily removed and replaced when the buffing material is glazed and is no longer effective. The entire unit is mounted in an enclosure 24 supplied with clean filtered air to maintain positive pressure within the enclosure to prevent contamination with debris and particulate from outside the enclosure while continually flushing the area of any contaminants generated in the application process. The air flow pressure and spray head pressure are set-up and controlled to prevent disturbance of the spray pattern. The scratch reduction apparatus or module is mounted in a photographic printer between the negative analysis module and the paper exposing station as depicted in the Photographic Printer Schematic, FIG. 4.

The wax composition can be a hard wax that has sufficient adhesion to the surface. Suitable wax includes carnauba wax, candelilla wax, japan wax, ceresin wax, synthetic wax, and mixtures of wax. Carnauba wax is most preferred. The surface of the applicator roll is for example precoated with a layer of the wax material or pre-impregnated with the wax material. The wax can be softened with a heating element to facilitate the application by rotating and rubbing. In this case, it is believed that the scratches are filled with the wax material allowing the scratches to be less visible.

The wax composition is preferably made of (a) a solvent, (b) an abrasive particle, (c) a petroleum distillate, (d) a hard wax, and (e) water. Such a composition can serve the dual function of removing minor surface scratches and contamination and filling deep surface scratches with hard wax material allowing the deep scratches to be less visible under light. The solvent is any solvent for the surface layer of the photographic material and enhances the action of the abrasive particles in removing the minor scratches and contaminate from the surface and forming a smooth new surface. Any solvent can be used but the most preferred one is acetone. The abrasive particle having an abrasive property that is effective in removing minor scratches and contaminate from a photographic material without having to remove much of the photographic material surface. The abrasive particles have mild abrasive property and a particle size ranging from 0.01 to 5 microns, preferably from 0.1 to 3 microns. Representative abrasive particles are aluminum oxide, crosslinked polymer beads, aluminum silicates, silicone dioxides, tin oxides, and mixture of these materials. The petroleum distillate serves the dual function of acting as carrier for the abrasive particles and as a solvent for the wax. Furthermore, it is believed that the petroleum distillate helps to clean and condition the surface of the photographic material. Suitable petroleum distillates include Narpar 15 from Chevron. Water is normally added in an amount to provide a desirable consistency to make the wax composition easily be impregnated by the applicator roll surface and spread to the surface of the photographic material. In the present invention, the wax composition preferably comprises about 15 to 25 wt % of a solvent, 10 to 35 wt % of an abrasive particle, 15 to 25 wt % of a petroleum distillate, 5 to 20 wt % of a hard wax, and 15 to 25 wt % water.

The photographic material according to the present invention comprises one or more imaging layer on one side of the support and on the other side of the support an outermost backing layer, or an outermost layer coated on the top of an antistatic layer, or an outermost layer coated on an magnetic recording layer. The outermost backing can be an abrasion resistance backing layer, a lubricant layer, or a scum control layer.

In a particularly preferred embodiment, the photographic material in accordance with this invention are photographic films in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic materials of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic material according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, glass and the like. Details regarding supports and other layers of the photographic elements of this invention are contained in Research Disclosure, Item 36544, September 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September 1994, and the references listed therein.

The photographic silver halide emulsions utilized in this invention can contain other addenda conventional in the photographic art. Useful addenda are described, for example, in Research Disclosure, Item 36544, September 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

EXAMPLES

Example 1

A Kodacolor Gold 400 film sample was developed in Process C 41 and was then placed on a rotating bed. Two arms each hold a CALIBRASE CS10F wheel (trademark of Taber Industries) such that the outer diameter of the wheel was in contact with the backside of the processed film. The load on each of the arms is 185 grams. The wheels rotate about their axis. The rotating bed was then allowed to make 100 revolutions under the rotating wheels. After the 100 revolutions of the bed, the sample was removed and examined by printing the abraded film sample onto photographic paper.

A sample of type 1 carnauba wax and another of type 4 carnauba wax were melted and allowed to solidify in small petridishes. After solidified, the wax was applied to sections of the abraded film sample, which was then reprinted. The sections that had the wax sample applied showed a significant reduction in the printable scratches.

Example 2

An abraded Kodacolor 400 film sample was generated in the same manner as in Example 1. A wax composition containing acetone solvent, carnauba wax, petroleum distillate, water, quartz silica, and oleic acid was applied to sections of the abraded film sample, which was then examined by specular transmitted light. The sections that had the wax composition applied showed almost no visible scratches and the sections that were not treated with the wax compositions were loaded with visible scratches.

The invention has been described in detail with particular reference to certain preferred embodiments thereof, but it will be understood that variations and modifications can be effected within the spirit and scope of the invention.

What is claimed is:

1. An apparatus for removing scratches from a photographic element comprising:

an application device for applying a wax composition to a surface of a moving photographic web; and a buffing device for buffing the surface of the web having the applied wax composition, wherein the application device comprises a heating element for maintaining an outer surface of an applicator roll to a predetermined temperature.

2. The apparatus of claim 1, wherein said application device comprises an applicator roll.

3. The apparatus of claim 2, wherein the applicator roll comprises a walled core surrounded by a foam material.

4. The apparatus of claim 1, wherein said buffing device comprises a buffing roll.

5. The apparatus of claim 4, wherein a surface of the buffing roll that contacts the surface of the web rotates in a direction opposite a direction of the web.

6. The apparatus of claim 1, further comprising a variable speed drive motor connected to an applicator roll drive mechanism via a drive belt and a pulley.

7. The apparatus of claim 6, further comprising a tensioning for tensioning the pulley.

8. The apparatus of claim 1, wherein said application device comprises a sponge.

9. The apparatus of claim 8, wherein the applicator device further comprises a pressure plate mounted to the sponge.

10. The apparatus of claim 1, further comprising:

a cleaning station for cleaning the surface of the photographic element prior to applying the wax composition.

11. An apparatus for removing scratches from a photographic element comprising:

a spray wax mechanism for applying a wax composition to a surface of a moving photographic web;

a dryer for drying the wax composition on the surface of the web and a buffing device for buffing the surface of the web having the applied wax composition and further comprising at least one spray guide cooperating with the spray wax mechanism to guide the wax to the surface of the web.

12. The apparatus of claim 11 further comprising a holding vessel for supplying the wax composition to the spray wax mechanism.

13. The apparatus of claim 11, wherein said buffing device comprises a buffing roll.

14. The apparatus of claim 13, wherein a surface of the buffing roll that contacts the surface of the web rotates in a direction opposite a direction of the web.

15. The apparatus of claim 11, further comprising:

a cleaning station for cleaning the surface of the photographic element prior to applying the wax composition.

* * * * *